United States Patent [19]

Tung

[11] 4,005,538

[45] Feb. 1, 1977

[54] INTERNALLY ILLUMINATED RETROREFLECTIVE SIGNS

[75] Inventor: Chi Fang Tung, Mahtomedi, Minn.

[73] Assignee: Minnesota Mining and Manufacturing Company, St. Paul, Minn.

[22] Filed: Aug. 29, 1975

[21] Appl. No.: 608,915

Related U.S. Application Data

[63] Continuation of Ser. No. 418,419, Nov. 23, 1973, abandoned, which is a continuation-in-part of Ser. No. 220,152, Jan. 24, 1972, Pat. No. 3,790,431, and Ser. No. 244,837, April 17, 1972, Pat. No. 3,802,944.

[52] U.S. Cl. ..... 40/132 R; 40/132 D; 40/135; 428/143

[51] Int. Cl.[2] ..... G09F 7/08

[58] Field of Search ..... 40/130 R, 130 B, 132 R, 40/132 D, 133 B, 134, 135, 136, 106.1; 161/3.5, 89

[56] References Cited

UNITED STATES PATENTS

| | | | |
|---|---|---|---|
| 2,130,704 | 9/1938 | Patzwaldt | 161/3.5 X |
| 2,390,663 | 12/1945 | Pollard | 40/136 |
| 2,411,222 | 11/1946 | Meigs | 40/135 |
| 2,624,967 | 1/1953 | Phillippi | 40/135 |
| 2,948,191 | 8/1960 | Hodgson et al. | 40/135 X |
| 3,164,124 | 1/1965 | Ehrsam | 116/20 |
| 3,176,420 | 4/1965 | Alverson | 40/135 |
| 3,455,045 | 7/1969 | Thomas | 40/135 |
| 3,510,976 | 5/1970 | Pauline et al. | 40/132 R |

*Primary Examiner*—Richard J. Apley
*Assistant Examiner*—Vance Y. Hum
*Attorney, Agent, or Firm*—Alexander, Sell, Steldt & DeLaHunt

[57] ABSTRACT

Internally illuminated signs incorporating light-transmissive retroreflective sheeting between the internal illumination source and the sign face in position to retroreflect light beamed against the sign face so as to make the signs retroreflective. Preferred sheeting comprises an open web of filaments encased by retroreflective microspheres.

2 Claims, 5 Drawing Figures

INTERNALLY ILLUMINATED RETROREFLECTIVE SIGNS

REFERENCE TO RELATED APPLICATIONS

This is a continuation of application Ser. No. 418,419, filed Nov. 23, 1973, now abandoned, which is in turn a continuation in part of pending applications Ser. No. 220,152, filed Jan. 24, 1972, now Pat. No. 3,790,431 and Ser. No. 244,837, filed Apr. 17, 1972, now U.S. Pat. No. 3,802,944.

BACKGROUND OF THE INVENTION

A principal advantage asserted for internally illuminated roadway signs is that they can be seen at night even when out of reach of headlights of approaching vehicles. But this internal illumination also becomes a serious disadvantage when the light source within the sign partially or wholly fails. Under such circumstances the sign may become partially or wholly illegible or inconspicuous, especially to motorists traveling at highway speeds at night.

Others have suggested ways for imparting retroreflectivity to internally illuminated signs. For example, in U.S. Pat. No. 3,510,976, it is suggested that a sign face be formed by partially embedding, as a monolayer in an adhesive layer coated on a transparent plate, a mixture of metallized glass microspheres and non-metallized microspheres. The metal on the protruding portions of the metallized microspheres is then removed, a clear material coated over the microspheres, and an opaque sign image painted over the clear layer. The non-metallized microspheres are said to transmit light from the internal source, while the metallized microspheres retroreflect light beamed against the front of the sign.

A major difficulty with a sign as described in U.S. Pat. No. 3,510,976 is that light is poorly transmitted through the non-metallized microspheres, and thus the internal illumination of the sign is greatly reduced. Further, it would be expensive to make existing signs retroreflective using the technique taught in the patent, since that would require replacement of the sign faces. Insofar as is known, signs such as taught in U.S. Pat. No. 3,510,976 have never become commercial.

SUMMARY OF THE INVENTION

The present invention provides retroreflective internally illuminated signs that permit good transmission of internal illumination and that can easily be made from existing internally illuminated signs. Briefly, a sign of the invention comprises a light source, a sign image supported in front of the light source so as to be readable from the front of the sign when back-lighted by the light source, and a light-transmissive retroreflective sheeting between the sign image and the light source, said sheeting comprising an array of retroreflective microspheres carried on a base support in a non-uniform pattern comprising areas densely packed with microspheres separated by light-transmissive spaces through which the light source illuminates the sign image. The sign is normally illuminated by the light source, but in the event that the light source wholly or partially fails, the sign can still be read by light beamed at the front of the sign and retroreflected by the retroreflective sheeting that is behind the sign image.

A preferred light-transmissive retroreflective sheeting useful in signs of the invention comprises, briefly, an open web of filaments that are encased around their whole circumference at least over those parts of their length that define open spaces of the web by a monolayer of minute retroreflective microspheres. Typically, the web of filaments is a fabric of interwoven filaments. Such open webs provide good light transmission, and in addition, they have good "angularity," meaning that they will retroreflect light striking them on a line that forms a substantial angle with a line normal to the web.

In more preferred embodiments of signs of the invention, the light transmissive web of filaments includes a layer of polymer-based material covering at least part of a first side of the web and closing openings in the web. (For purposes herein, "open" means that the encased filaments are separated from one another so that there are significant light-transmitting spaces between the encased filaments; and a web or fabric of encased filaments is considered open or open-mesh even though part or all of the openings are closed by polymer-based material.) The polymer-based material in these embodiments is generally pigmented to make the layer both light-diffusing and light-transmissive, whereupon the sheeting provides not only retroreflective properties but also serves as a light-diffusing panel in the sign. Signs made retroreflective without this pigmented layer tend to have an unattractive metallic gray tint because of the gray color of the retroreflective microspheres on the filaments. But because of the close proximity of the pigmented polymer-based layer to the microspheres, and the blocking of portions of the sides and backs of the retroreflective filaments by the pigmented polymer-based material, the color of the sign is significantly improved.

DETAILED DESCRIPTION

Figure 1:
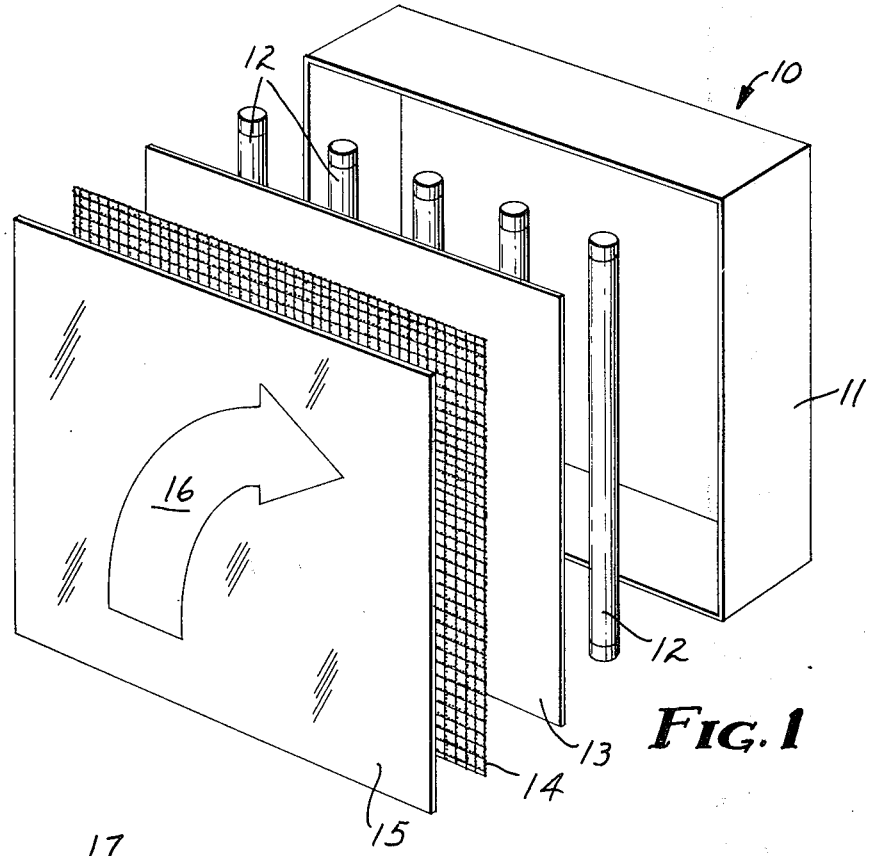
FIG. 1 is an "exploded" schematic perspective view of a representative retroreflective internally illuminated sign of the invention.

FIG. 1 shows in an "exploded" schematic representation an illustrative internally illuminated, or back-lighted, sign 10 of the invention, which comprises a box-like enclosure 11; a light source that comprises a set of tubular light bulbs 12 and a diffuser panel 13; a light-transmissive retroreflective sheeting 14 of the invention; and a transparent sign face 15 carrying a sign image 16 visible from the front of the sign when the sign face is illuminated from the back by the light source. A diffuser panel is not necessary, but is preferred so that light traveling through the sign face is substantially uniform over the whole area of the sign face. The sign image is almost always supported on a transparent sign face, though for special effects it could be supported in some other way (as by suspension on wires) and could be in front of or behind the sign face.

Figure 2:
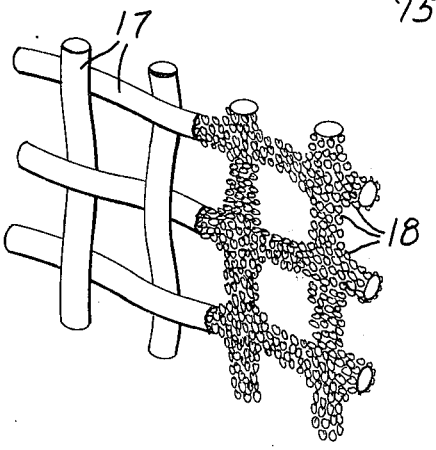
FIG. 2 is a greatly enlarged perspective view of a light-transmissive retroreflective fabric useful in signs of the invention, shown with the layer of microspheres broken away to reveal the base fabric.

A light-transmissive retroreflective fabric useful in a sign of the invention is illustrated in closeup in FIG. 2, and comprises a basic fabric of woven filaments 17, a layer of binder material (not shown) coated on the filaments, and a monolayer of microspheres or beads 18 each partially embedded and adhered in the layer of binder material (the layer of microspheres is partially broken away to show the base fabric); the embedded surfaces of the microspheres are preferably covered with a reflective material such as vapor-coated aluminum. As previously noted, a light-transmissive retroreflective sheeting as shown in FIG. 2 is especially preferred as the light-transmissive retroreflective sheeting in a sign of the invention, because such a sheeting provides good light transmission and also has good "angularity." For example, some light-transmissive retroreflective fabrics of interwoven filaments can retroreflect, with 50% of original brightness, light striking the sheeting at an angle of 70°–80° to the normal to the sheeting.

A typical method for preparing a light-transmissive retroreflective fabric as shown in FIG. 2 includes the steps of coating binder material on a base fabric having filaments of the desired denier and the desired percentage of open area; applying microspheres completely covered with a reflective material to the coated fabric while the binder material is in a tacky state so that the microspheres become partially embedded in the layer of binder material; drying or curing the binder material to advance it to a non-tacky durable adherent condition; and removing the layer of reflective material that covers the exposed surfaces of the microspheres, as by etching. Light-transmissive retroreflective sheeting can also be prepared by weaving or otherwise grouping into an integral whole a web of filaments that have been previously coated with retroreflective elements, but such a method is much more difficult than preparing the light-transmissive retroreflective fabric from an already prepared base fabric, and such precoated filaments cause substantial wear on weaving equipment. Instead of being woven as a fabric, only parallel filaments supported in an exterior frame may be used as a retroreflective sheeting in some signs of the invention.

The base filaments in a retroreflective web of the invention are made from a variety of materials, such as cellulose-based materials, synthetic polymers, or metal. And they are sometimes made of material that can be heat-formed, whereby the web is given a non-planar configuration. Such a configuration is useful, for example, when the sign face is three-dimensional. Metal filaments or other filaments that are electrically conductive and generate heat by passage of an electric current are useful in signs of the invention to keep the sign face free from condensed moisture or frost. In one advantageous construction of this type, a transparent front plate of a sign is laminated in slightly spaced relation to retroreflective sheeting that incorporates such conductive filaments. Or conductive filaments may be disposed between retroreflective sheeting and a transparent front plate to which the sheeting is laminated.

The binder material on a light-transmissive retroreflective web of filaments is preferably elastomeric to permit the sheeting to be rolled, as for shipment, and to facilitate an otherwise easy handling of the sheeting. One such useful elastomer-forming binder material comprises a polyether polyamine of high amine functionality, such as poly (tetramethyleneoxide) diamine taught in Hubin et al., U.S. Pat. No. 3,436,359, and diglycidyl ether of bisphenol A. This material cures to form a very strong bond with partially embedded silver- or aluminum-coated glass microspheres. Other useful binder materials include natural rubber, acrylic resins, and polyvinyl butyral resins.

Figure 3:
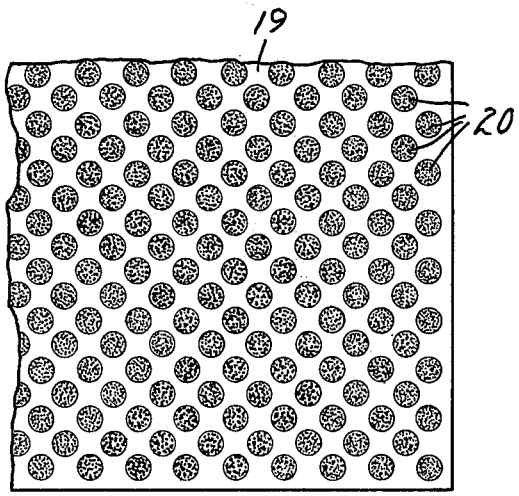
FIG. 3 is a plan view of a different light-transmissive retroreflective sheeting useful in signs of the invention.

Another type of light-transmissive retroreflective sheeting for use in internally illuminated signs of the invention is shown in FIG. 3. This sheeting includes a transparent film on which small dots 20 of retroreflective microspheres have been deposited (such a sheeting is prepared, for example, by depositing tacky binder material in a pattern of dots on the film, then cascading metal-coated microspheres over the sheeting, then advancing the binder material to a dry adherent condition, and then etching off the metal from the nonembedded portions of the microspheres). Other types of retroreflective sheeting useful in signs of the invention include conventional microsphere-based retroreflective sheeting that has been punched to form light-transmissive spaces; tapes of retroreflective material grouped together to form a network of retroreflective areas separated by light-transmissive areas; or fabrics to which retroreflective dots have been laminated.

Figure 4:
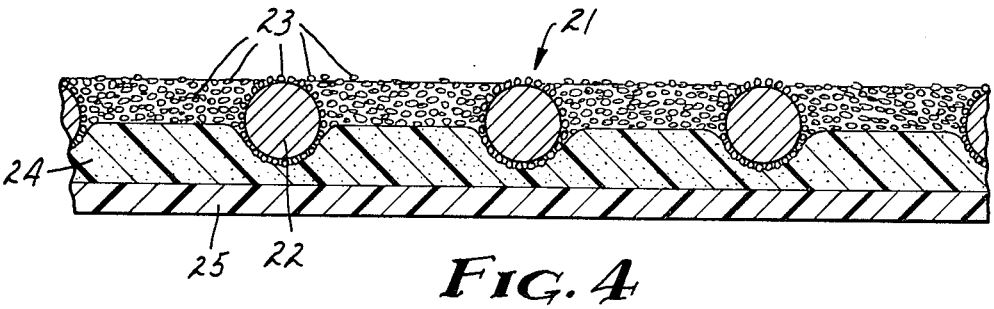
FIG. 4 is a section through part of a different illustrative retroreflective sheeting useful in signs of the invention.

The illustrative retroreflective sheeting 21 shown in FIG. 4 comprises an open-mesh fabric of filaments 22 encased by a monolayer of minute retroreflective microspheres 23. A layer 24 of polymer-based material extends over a first side of the fabric, closing and partially filling the openings between the microsphere-encased filaments in the fabric. In the embodiment illustrated in FIG. 4, the polymer-based layer 24 is pigmented so as to make the layer light-diffusing and light-transmissive, though for some retroreflective sheeting of the invention, the polymer-based layer is not pigmented. A support sheet 25 is attached to the bottom of the layer 24 of polymer-based material, this support sheet being an optional element useful during manufacture of the retroreflective sheeting and also providing physical protection for the polymer-based layer and mechanical support to the whole sheeting.

Figure 5:
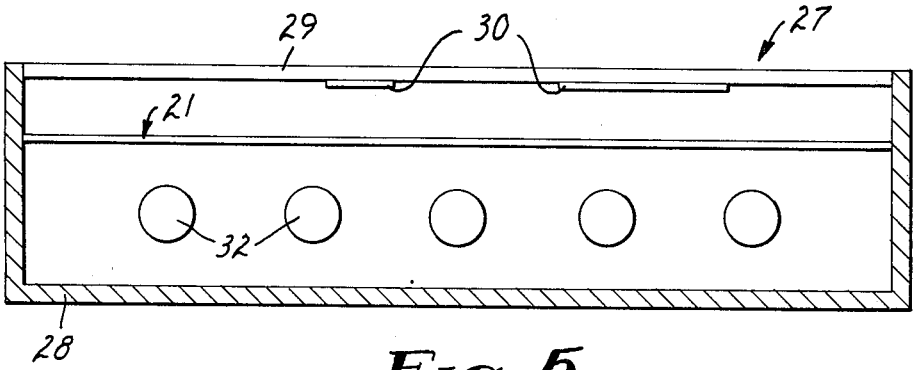
FIG. 5 is a section through an illustrative sign that incorporates retroreflective sheeting as shown in FIG. 4.

FIG. 5 illustrates a sign 27 that incorporates retroreflective sheeting 21 such as shown in FIG. 4. The sign 27 comprises an open-sided box-like enclosure 28, a transparent front plate 29 covering the open side of the enclosure and carrying a sign image 30, light-transmissive light-diffusing retroreflective sheeting 21 such as shown in FIG. 4, and a set of tubular lamps 31, such as neon or fluorescent lamps. When the lamps 31 are lit, their light travels through the light-diffusing retroreflective sheeting 21 and through the transparent front plate 29 to make the image 30 on the front plate visible to viewers of the sign. At night when a light is beamed against the front plate 29, that light travels through the front plate, is retroreflected by the retroreflective light-diffusing sheeting 21, and returns along substantially the same path that it traveled to the sign to greatly enhance the brightness of the sign; and if the lamps 31 are for some reason not illuminated, such reflected light will make the sign image 30 visible to persons within the range of the reflected light.

One method for incorporating a web of microsphere-encased filaments into retroreflective sheeting as shown in FIG. 4 is to press the web into a preformed layer of polymer-based material that is flowable, either at room temperature or at an elevated temperature, and that will develop adhesion to the web. Desirably the polymer-based layer is carried during this operation on a support sheet, such as the sheet 25 shown in FIG. 4, or on a removable release liner; and the side of the web opposite from the polymer-based layer is covered with a sheet that either forms part of the final structure or is removable.

By changing the process parameters, such as the amount of pressure applied, the thickness of the layer of polymer-based material before the web of microsphere-encased filaments is pressed against it, the flowability of the material, or the temperature of the pressing operation, the degree to which the polymer-based material fills the openings in the web can be varied from a very slight amount to a very large amount. In the embodiment shown in FIG. 4, portions of the polymer-based layer fill approximately half of each of the openings between the encased filaments, and this amount of filling has been found to represent a desirable compromise for sheeting that includes pigmented polymer-based material: The more filling, the better the color of the sheeting; but the more filling, the less bright will be the retroreflection of light that strikes the sheeting at an angle other than normal to the sheeting. In some embodiments, even pigmented polymer-based material extends completely through the openings to adhere a front sheet or plate, such as a sign face, to the retroreflective sheeting.

Sufficient pigment is included in the polymer-based layer in sheeting as shown in FIG. 4 to obtain the desired degree of light-diffusion and light-transmission. Typically, light-diffusing panels used in illuminated signs transmit about 50 percent of the light striking them. The amount of light-transmission can also be controlled by changing the thickness of the pigmented polymer-based layer. Other means to make the layer of polymer-based material light-diffusing can also be used, as by foaming the layer or by using a translucent support sheet 25. When pigmented, the polymer-based material may be pigmented in a variety of colors to give different effects as desired. Phosphorescent or fluorescent pigments may also be used for special effects.

A variety of film-forming polymer-based materials may be used in the layers 24 of retroreflective sheeting such as shown in FIG. 4. For the method for making such retroreflective sheeting described above, a pressure-sensitive adhesive polymer such as the acrylate polymers described in Ulrich, U.S. Pat. No. Re. 24,906, is useful. Such materials exhibit tackiness and flow properties such that, after they have been coated onto a support sheet, a web of retroreflective filaments may be readily pressed into the layer to produce a structure such as shown in FIG. 4. Other polymers are also used, however, such as heat-softenable polymers into which the web of filaments can be pressed in the presence of heat. It is desirable that the polymer-based material have elastomeric properties so as to permit convenient handling of the sheeting. Usually the polymer-based material is clear and transparent prior to pigmentation.

If polymer-based materials of standard indices of refraction are coated in contact with the exposed surface of microspheres on filaments in retroreflective sheeting such as shown in FIGS. 2 and 4, the microspheres will not retroreflect light impinging on them. This fact is useful to provide retroreflective sheeting capable of special effects. For example, if the front side (that side that receives light for reflection) of a retroreflective sheeting such as shown in FIGS. 2 and 4 and is selectively coated with transparent polymer-based material in a pattern providing graphic information and the resulting sheeting inserted in a sign as shown in FIGS. 1 and 5, the graphic information will not be visible during the day time, but will be visible at night when light is beamed against the sign. Thus special speed limits to take effect at night may be made visible at the time needed.

The light-transmissive retroreflective sheeting in an internally illuminated sign as described herein is chosen to have an amount of open area—that is, the area of spaces between the encased filaments—that provides a desired balance of light-transmission and reflection. Preferably, the web of filaments will transmit (prior to incorporation of a polymer-based layer of some embodiments of the invention), at least 20 percent, and more preferably at least 40 percent, of the light impinging on the web (the percent open area of a web of encased filaments may be indicated by the amount of light-transmission through the web; the percent-transmission numbers are assumed to describe the percent open area of web, and the nontransmitting portions of the web are assumed to be retroreflective). On the other hand, so that the retroreflective sheeting of the invention will provide good retroreflection, the web will preferably transmit no more than 80 percent, and more preferably no more than 60 percent of light striking it. Adequate light-transmission and reflection can also be obtained with sheeting in which the web has a percentage of open area outside these ranges; for example, by increasing the brightness of the light bulbs in the sign, a sheeting transmitting as little as 5 percent of the light impinging on it may be used; and sheeting transmitting as much as 90 or 95 percent of light has reflection characteristics useful for some purposes.

The retroreflective microspheres in light-transmissive retroreflective sheeting are usually not in optical contact with the sign face in the assembled condition of the sign. For many purposes, the sheeting is spaced far enough from the sign face so that light from the light source transmitted through the sheeting will spread sufficiently to eliminate or minimize any shadow cast by the sheeting on the sign face. However, as previously noted, retroreflective sheeting can be laminated directly to a sign face.

Also, a light-transmissive retroreflective sheeting is least noticeable in an internally illuminated sign when the light-transmissive spaces and the densely packed areas of microspheres are very fine or small. Thus, a light-transmissive retroreflective fabric is least noticeable when the diameter of the microsphere-encased filaments is less than 500 microns and preferably less than 250 microns, and the smallest dimension of the spaces between the encased filaments is less than one millimeter, and preferably less than 500 microns. The glass microspheres or beads are of a size such that a dense monolayer of them can be coated on the filament without unduly reducing the size of the spaces between the filaments.

In sheeting for use in some signs of the invention and in sheeting intended for other uses, the size of the encased filaments and openings may be outside the ranges listed above. Also, the fabric of base filaments from which the sheeting is prepared may be woven in a pattern such that some filaments are close together, while other filaments are spaced further apart. For example, the fabric may have a checkerboard pattern, such that after microspheres have been applied to the fabric, there are no openings between some adjacent filaments.

The invention will be further illustrated by the following examples.

EXAMPLE 1

A fabric of 200-micron-diameter nylon filaments woven in a weave using 20 filaments per inch (8 filaments per centimeter) was first roller-coated with a primer to fill up all crevices in the filament. The primer material was a 10-weight-percent-solids solution in toluene of the following ingredients:

| | Parts by Weight |
|---|---|
| Poly (tetramethyleneoxide) diamine that has a number-average molecular weight of 10,000, an amine equivalent weight of 4610, and a viscosity at 65° C of 49,500 centipoises, and that was prepared according to the procedures of Examples 1–4 of Hubin et al, U.S. Pat, 3,436,359 | 100 |
| 2,4,6-tris-dimethylaminomethylphenyl catalyst (DMP-30) | 2.5 |
| Diglycidyl ether of bisphenol A having an epoxide equivalent weight of 180–195 (Epon 828) | 50 |
| Stannous octoate catalyst | 5 |

This primer coating was then cured at 150° F (66° C) for 30 minutes. After the fabric had cooled to room temperature, a binder material of the same ingredients listed above but dissolved at 30-weight-percent solids in toluene was coated on the fabric, after which the coated fabric was exposed to jets of compressed air to remove excess binder material and keep the spaces between filaments open. While the layer of binder material was still wet and tacky, the fabric was passed through a "fluidized bed" of aluminum-vapor-coated glass microspheres 37 to 88 microns in diameter (the fabric passed over a trough containing microspheres that were shot upward by a set of compressed air nozzles at the bottom of the trough, with a canopy above the fabric returning the microspheres toward the fabric), whereupon the filaments of the fabric became individually encased by a densely packed monolayer of microspheres adhered to and partially embedded in the coating of binder material. The layer of binder material was then cured at 150° F (66° C) for one hour, after which the aluminum on the exposed portions of the microspheres was removed by etching with an alkali solution.

The resulting light-transmissive retroreflective sheeting had an open area of about 50 percent (determined by measuring the light in photovolt units (PV) returned by an assembly that comprised the sheeting before the aluminum was removed (which is known to have a PV of zero) over a standard sheeting known to have a PV of 57 using a photometer that had been calibrated with the standard 57 PV sheeting; the assembly was measured as having a PV of 30, meaning that the percent open area of the light-transmissive sheeting of this example was 30/57 times 100 percent, or about 50 percent). The sheeting was disposed in a sign having a 24-inch-by-24 inch (63.5-centimeter-by-63.5 centimeter) transparent glass-plate sign face carrying no image; the sign was lighted by a bank of four 40-watt fluorescent light bulbs through a diffuser panel of white translucent plastic sheeting spaced 4 inches (10 centimeters) in front of the bulbs. The light from the sign was then measured under various combinations of the following conditions: with the light-transmissive retroreflective sheeting ("screen" in the table below) in place and not in place between the sign face and diffuser panel; with the sign illuminated by a headlight (having 3950 candle power at 12.5 feet (3.8 meters)) and not illuminated; and with the internal lights on and not on. The light was measured through a photocell and galvanometer 50 feet (15.2 meters) away from the sign, and the headlight was adjacent the photocell. The sign was turned so that the angle of incidence of light on the sign from the headlight was varied between 0° and 60° from the normal of the sign face. The results were as follows, the numbers given being readings on the galvanometer:

| | | | | Angle of Incidence | | | | | | |
|---|---|---|---|---|---|---|---|---|---|---|
| Test Number | Internal Light | Head-light | Screen | 0° | 10° | 20° | 30° | 40° | 50° | 60° |
| 1 | on | off | out | 29.5 | 29.1 | 27.7 | 25.0 | 21.5 | 17.2 | 12.1 |
| 2 | on | off | in | 14.8 | 13.5 | 12.6 | 11.1 | 9.0 | 6.8 | 4.1 |
| 3 | off | on | in | 53.0 | 52.2 | 50.3 | 46.3 | 39.4 | 29.8 | 19.4 |
| 4 | on | on | in | 67.6 | 66.3 | 63.5 | 57.8 | 48.1 | 36.0 | 22.2 |
| 5 | off | on | out | 2.83 | .1 | .1 | .1 | .1 | .09 | .09 |

EXAMPLE 2

Pigment-grade titanium dioxide was dispersed in isopropanol in a ratio of 50 weight-percent titanium dioxide and 50 weight-percent isopropanol. A 20-weight-percent-solids solution in heptane of a copolymer of iso-octyl acrylate and acrylic acid was then mixed with the pigment dispersion in a high speed blender in a ratio of 20 weight-percent of the dispersion and 80 weight-percent of the solution.

The resulting mixture was coated onto a one-mil-thick (25-micron-thick) polyethylene terephthalate film in an amount providing a 6-mil-thick (150-micron-thick) wet coating, after which the coating was dried for 15 minutes at 150° F (66° C), or until the solvent evaporated. The microsphere-encased fabric of Example 1 was then laid over the dried coating and gently squeezed against the coating with a rubber roller. A one-half-mil-thick (12.5-micron-thick) polyethylene terephthalate film serving as a removable cover sheet was then laid over the exposed side of the microsphere-encased fabric, and the complete assembly laid in a vacuum applicator, which comprises a perforated support table, a hinged rubber diaphragm that is pivotable into place over the perforated table so that the table and diaphragm form a vacuum chamber, and a hinged cover carrying a set of heat lamps that is pivotable into place over the rubber diaphragm. The assembly was arranged so that the back side of the assembly was against the rubber diaphragm. A vacuum of about 25 inches (63 centimeters) of mercury was then drawn while the assembly was heated to and held at 250° F (121° C) for one minute. The assembly was then removed from the applicator and the cover sheet removed, leaving a retroreflective sheeting as illustrated in FIG. 1.

What is claimed is:

1. An illuminated sign comprising a box-like enclosure closed over its whole periphery except for an opening at the front of the sign, a light source within the enclosure, a transparent plate supported in front of the light source and carrying a printed image that is readable at the front of the sign by light from the light source, and light-diffusing means and a retroreflective light-transmissive sheeting between the transparent plate and the light source, and extending uniformly over the whole area defined by said opening, said sheeting comprising an open-mesh fabric of filaments that are encased around their whole circumference over at least those parts of their length that define open spaces of the web by a monolayer of minute transparent microspheres, the microspheres being partially embedded in a layer of binder material coated on the filaments and partially exposed above the layer of binder material whereby at least at the front of the sign the microspheres are uncovered over the whole area of said opening and open to the air, and said microspheres being covered over their partially embedded surface with specular reflective material, said sheeting permitting the light source to illuminate the sign image through the open spaces of the fabric while also retroreflecting light incident on the sign so as to further illuminate the sign image.

2. A sign of claim 1 in which said light-diffusing means comprises a layer of pigmented polymer-based material into which the open-mesh fabric has been partially embedded.

* * * * *